US007392750B2

(12) United States Patent
Schiefer

(10) Patent No.: US 7,392,750 B2
(45) Date of Patent: Jul. 1, 2008

(54) INTERNAL CEILING CLADDING FOR A LARGE VEHICLE FOR PASSENGER TRANSPORT IN PARTICULAR A RAIL VEHICLE

(75) Inventor: Benno Schiefer, Düsseldorf (DE)

(73) Assignee: Siemens Aktiengesellschaft, Munich (DE)

( * ) Notice: Subject to any disclaimer, the term of this patent is extended or adjusted under 35 U.S.C. 154(b) by 259 days.

(21) Appl. No.: 10/556,397

(22) PCT Filed: Apr. 20, 2004

(86) PCT No.: PCT/EP2004/004180

§ 371 (c)(1),
(2), (4) Date: Nov. 10, 2005

(87) PCT Pub. No.: WO2004/101342

PCT Pub. Date: Nov. 25, 2004

(65) Prior Publication Data

US 2006/0248835 A1 Nov. 9, 2006

(30) Foreign Application Priority Data

May 14, 2003 (DE) ..... 103 21 661

(51) Int. Cl.
*B61D 17/00* (2006.01)

(52) U.S. Cl. ..... 105/397; 296/210

(58) Field of Classification Search ..... 105/286, 105/329.1, 334, 343, 355, 396, 397; 52/506.01; 296/178, 208, 210, 214
See application file for complete search history.

(56) References Cited

U.S. PATENT DOCUMENTS

| | | | | |
|---|---|---|---|---|
| 2,251,682 | A * | 8/1941 | Leadbetter | 454/108 |
| 2,264,637 | A * | 12/1941 | Landell | 105/329.1 |
| 2,502,320 | A * | 3/1950 | Guernsey | 296/178 |
| 2,587,807 | A * | 3/1952 | Arenberg et al. | 362/479 |
| 3,210,875 | A * | 10/1965 | Schwenkler | 362/479 |
| 5,857,758 | A * | 1/1999 | Dealey et al. | 362/551 |
| 6,318,797 | B1 * | 11/2001 | Bohm et al. | 296/210 |
| 6,416,116 | B1 * | 7/2002 | Stanton et al. | 296/178 |

FOREIGN PATENT DOCUMENTS

| | | |
|---|---|---|
| DE | 41 32 360 A1 | 4/1993 |
| DE | 197 23 185 A1 | 12/1998 |
| DE | 197 46 795 A1 | 4/1999 |
| DE | 100 44 661 A1 | 3/2002 |
| EP | 1 186 499 A2 | 3/2002 |
| RU | 26833 | 12/2002 |

OTHER PUBLICATIONS

International Search Reports.
Russian Office Action dated Jan. 24, 2008.

* cited by examiner

*Primary Examiner*—Lars A Olson
(74) *Attorney, Agent, or Firm*—Harness, Dickey & Pierce

(57) ABSTRACT

An internal ceiling cladding for a large vehicle for passenger transport, in particular, a rail vehicle, includes a cladding element, arranged in the vicinity of a door drive and arched elements adjacent thereto. The cladding element is provided as base module and includes a surface on the side thereof facing the vehicle longitudinal centre for the exact matching up of a further cladding element.

10 Claims, 5 Drawing Sheets

INTERNAL CEILING CLADDING FOR A LARGE VEHICLE FOR PASSENGER TRANSPORT IN PARTICULAR A RAIL VEHICLE

This application is the national phase under 35 U.S.C. § 371 of PCT International Application No. PCT/EP2004/004180 which has an International filing date of Apr. 20, 2004, which designated the United States of America and which claims priority on German Patent Application number DE 103 21 661.8 filed May 14, 2003, the entire contents of which are hereby incorporated herein by reference.

FIELD

The invention generally relates to an internal roof or ceiling cladding for a large-capacity vehicle for passenger transport, in particular a rail vehicle. The cladding may include, for example, a cladding element arranged in the region of a door drive, and coving elements adjoining the cladding element in the longitudinal direction of the vehicle.

BACKGROUND

It is generally customary in rail vehicles for door drives arranged on the roof side to be clad by way of a respective element and for there to be arranged between these elements coving elements which likewise form part of the internal cladding. As a rule, the design and especially the shaping of the cladding elements and of the coving elements are fixed at the actual vehicle design phase, frequently in collaboration with the customer. The appearance which is thereby imparted to the vehicle is barely capable of being altered subsequently, in particular after the vehicle has been delivered, unless at considerable cost.

The aforementioned disadvantage is applicable for example to what is disclosed in the publication EP 1 186 499 A2, namely a coach body of a rail vehicle having an internal cladding which is arranged in the roof region and which includes three cladding sections extending transversely with respect to the longitudinal direction of the coach body. An air duct is in each case fitted between the central cladding section and the two lateral cladding sections. The underside of these air ducts is situated in the plane of the lateral cladding sections, with the result that the air ducts can be fitted into the contour of the internal cladding.

The prior art also includes, by way of the document DE 197 46 795 A1, a large-capacity vehicle in which an internal cladding for the ceiling region includes two sandwich cover plates which are each formed continuously over the length of the vehicle and cover one half of the roof. This internal cladding which defines the appearance of the vehicle is also virtually no longer capable of being modified to any degree after the vehicle has been delivered.

SUMMARY

An object of at least one embodiment of the invention is to provide a cladding design for a vehicle of the generic type which allows vehicles to be produced whose visual appearance can be modified at little cost and with little outlay on parts. These modifications should also be possible after a customer has decided on a specific vehicle configuration and, if appropriate, even after the vehicle has gone into service.

An object may be achieved according to at least one embodiment of the invention in that the cladding element has on its side facing the longitudinal center of the vehicle a bearing surface for making contact in a precisely fitting manner with a complementary surface formed on a further cladding element.

At least one embodiment of the invention may advantageously ensure that at the start of an order the customers have the option of ordering a variant of the vehicle which, in terms of the internal cladding, is basic, simple and therefore inexpensive. It is further possible for this vehicle to be retrofitted with cladding elements at any time or even to have its entire interior design modernized after a number of years.

BRIEF DESCRIPTION OF THE DRAWINGS

The invention will be described in further detail below with the aid of example embodiments which are illustrated in the drawings, in which.

DETAILED DESCRIPTION OF THE EXAMPLE EMBODIMENTS

Figure 1:
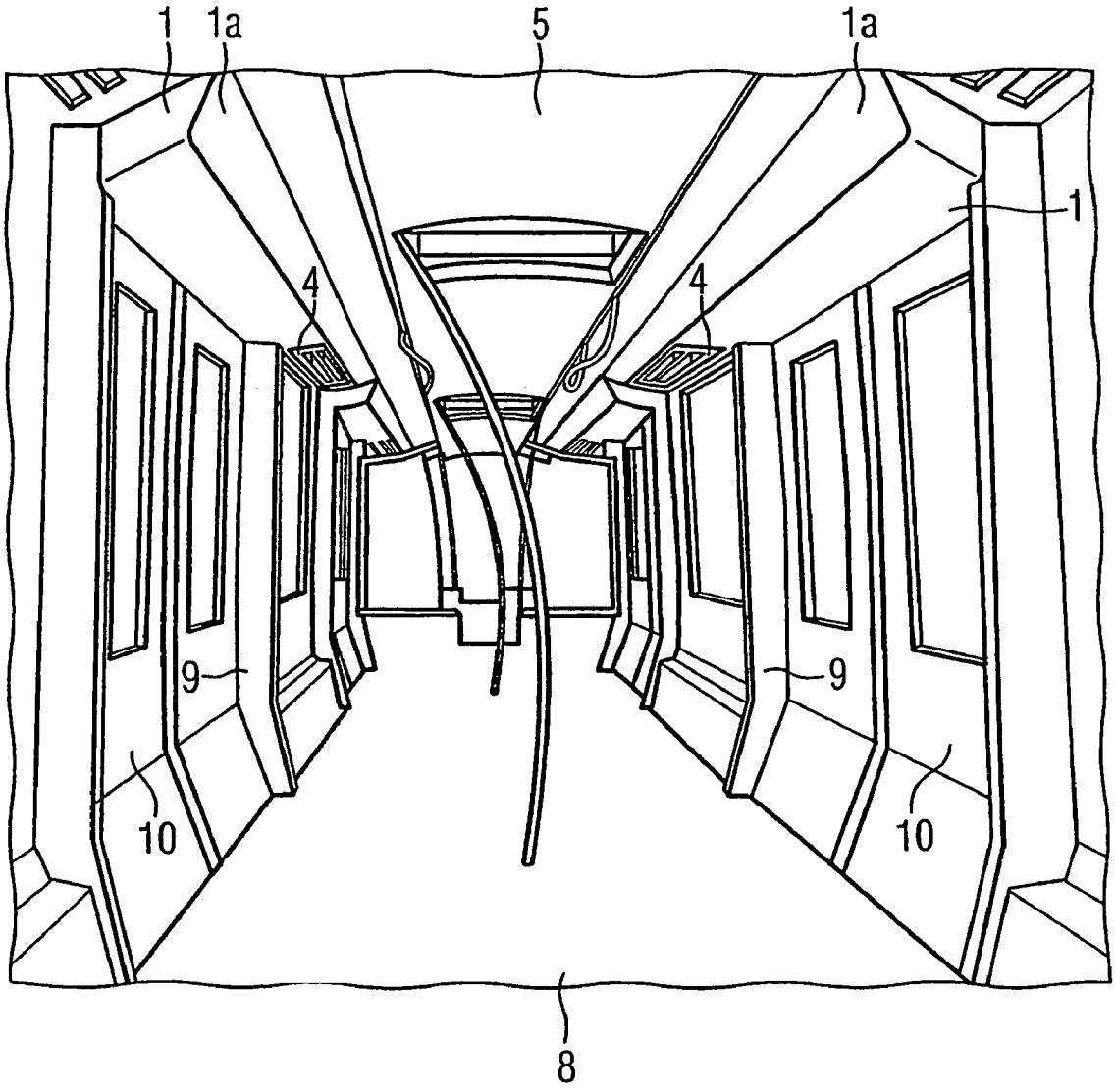
FIG. 1 is a perspective view showing the interior of a vehicle for passenger transport.
Figure 2:
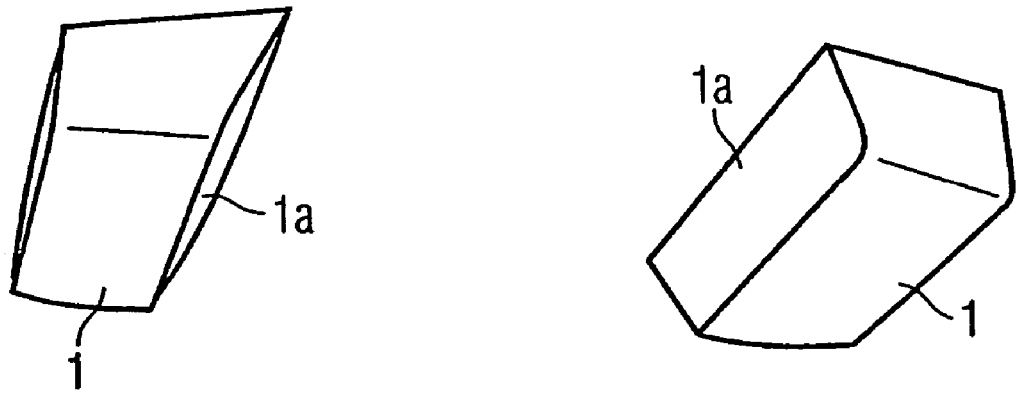
FIG. 2 shows a cladding element for a door drive, forming a base module.
Figure 3:
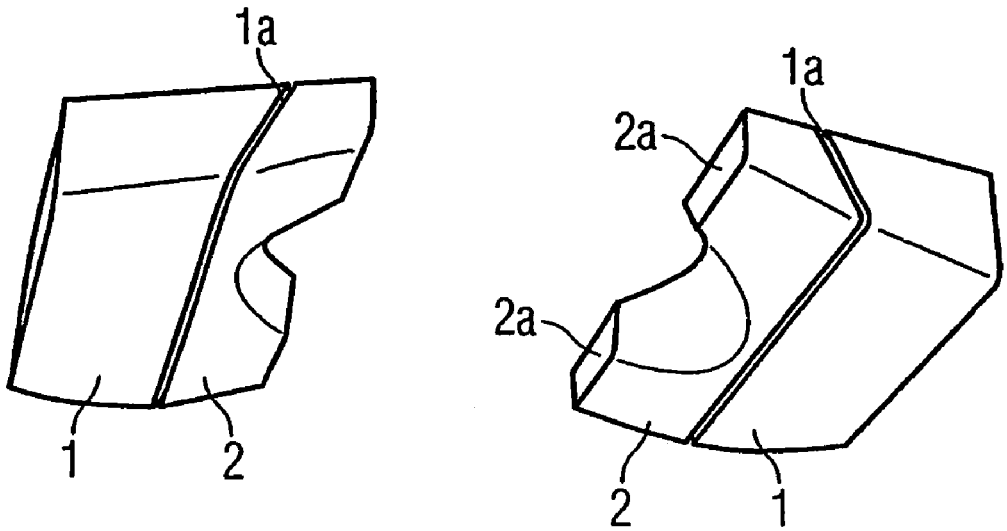
FIG. 3 is a view based on FIG. 2 showing a further cladding element.

The vehicle has a floor 8, side walls 10 provided with doors 9, and a roof 5. Cladding elements 1 are arranged in the region of door drives and they are adjoined by coving elements 4. The cladding elements 1 are in each case provided as a base module and are preferably connected to the side walls 10 via concealed hinges. A result is that the door drives are readily accessible for maintenance work. Each cladding element 1 is provided on its side facing the longitudinal center of the vehicle with a surface 1*a* for seating at least one further cladding element 2 in a precisely fitting manner.

The further cladding elements 2 may be designed as decorative end-pieces. Alternatively, the further cladding elements 2 may have on their side facing the longitudinal center of the vehicle a surface 2*a* for seating additional cladding elements 3 in a precisely fitting manner.

Figure 4:
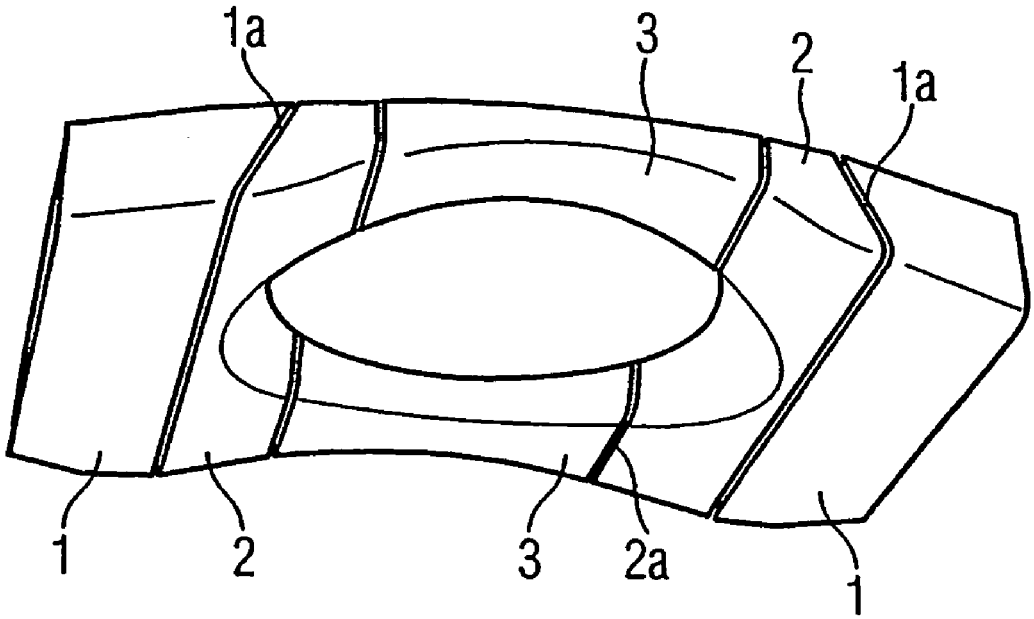
FIG. 4 is a view based on FIG. 3 showing an additional cladding element in a first configuration.
Figure 5:
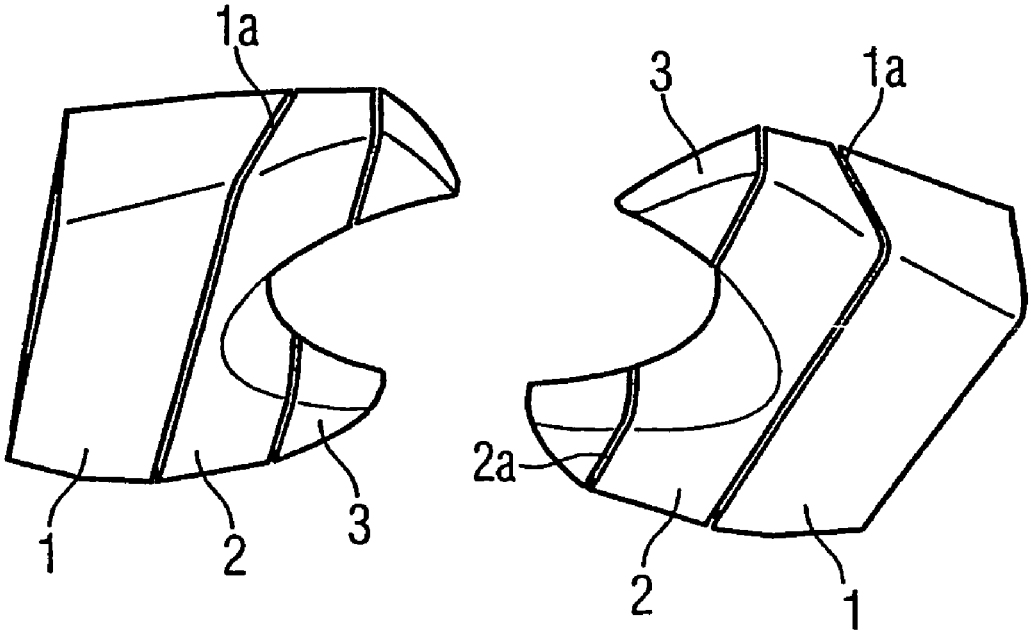
FIG. 5 is a view based on FIG. 3 showing an additional cladding element in a second configuration.

According to FIG. 4, these additional cladding elements 3 are arranged between two further cladding elements 2 situated opposite one another in the transverse direction of the vehicle, and thus span the central region of the roof 5. A modification (not shown) includes configuring the further cladding elements 2 in such a way that, in a manner corresponding to the additional cladding elements 3, they may be arranged between two cladding elements 1 situated opposite one another in the transverse direction of the vehicle and likewise span the central region of the roof 5. Moreover, the further cladding elements 2 may also be used as intermediate pieces for simple adaptation to different vehicle widths.

Figure 6:
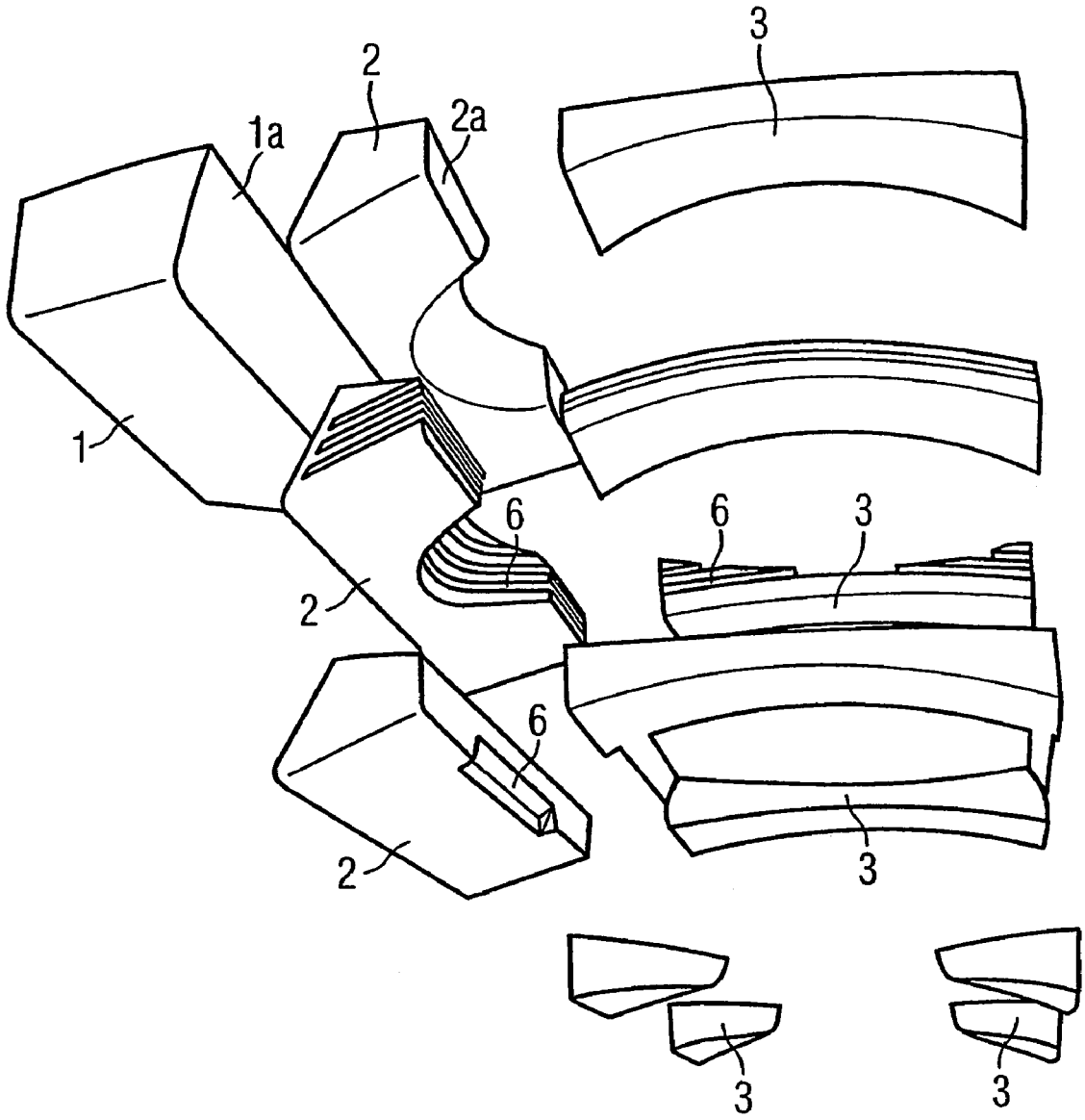
FIG. 6 is a perspective partial view showing a modular arrangement of cladding elements, including lighting units.
Figure 7:
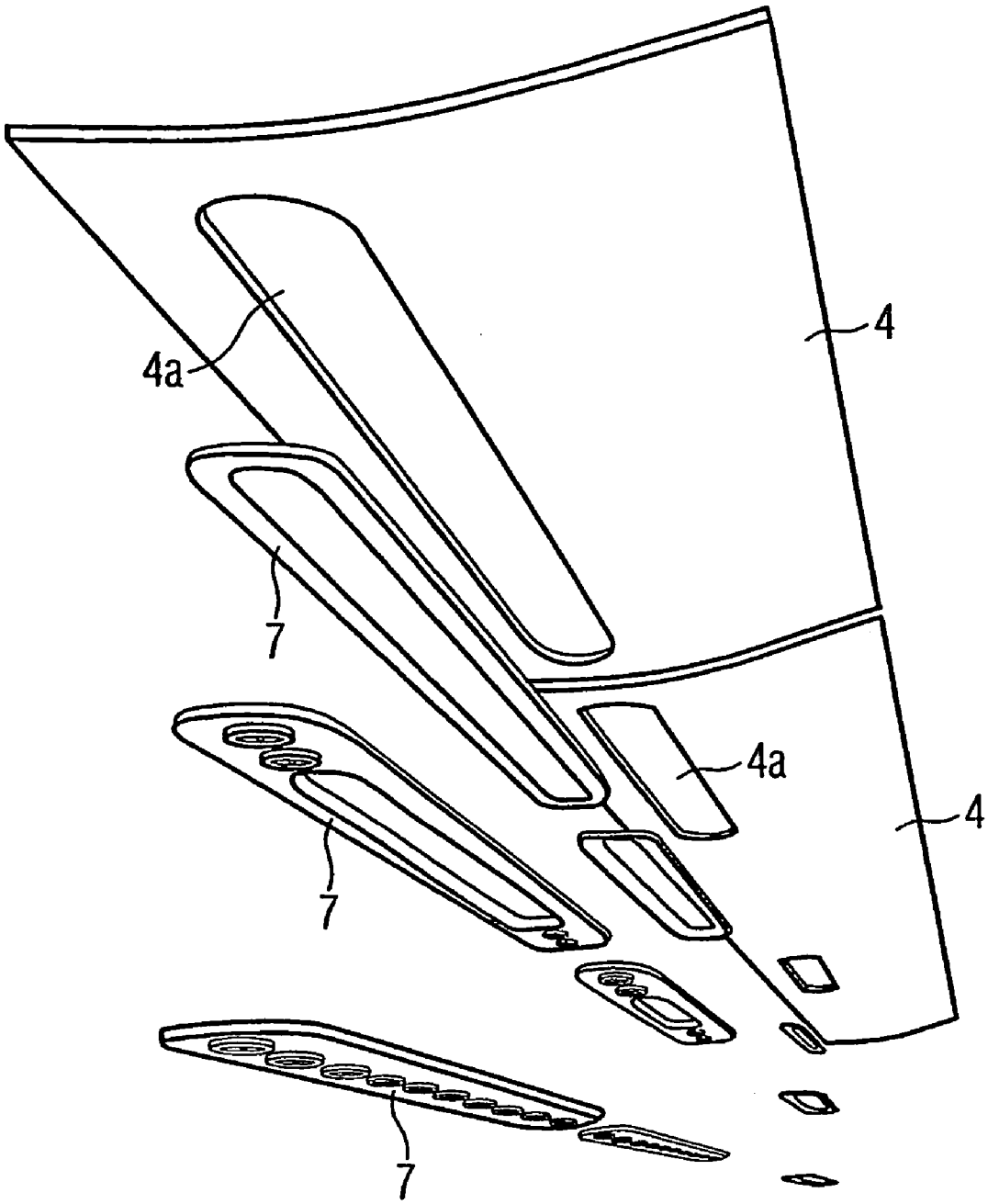
FIG. 7 is a perspective view showing coving elements and their lighting units.

The cladding elements 1, 2 and 3 may optionally be equipped with a lighting unit 6 (see FIG. 6). It is possible for the coving elements 4, too, to have a lighting unit 7 which preferably includes a lighting fixture which is fitted into a cutout 4*a* in the coving element 4 and is detachably connected to the coving element 4 for replacement purposes. The lighting fixture may for example contain a fluorescent tube and/or round lamps (spotlights). The particular ideas that the customers have with regard to vehicle lighting may be taken into account in a simple manner.

| List of reference numbers | |
|---|---|
| 1 | cladding element (base module) for the door drive |
| 1a | bearing surface |
| 2 | further cladding element |
| 2a | bearing surface |
| 3 | additional cladding element |
| 4 | coving element |
| 4a | cutout |
| 5 | roof |
| 6 | lighting unit for the cladding element |
| 7 | lighting unit for the coving element |
| 8 | floor |
| 9 | door |
| 10 | side wall |

The invention claimed is:

1. An internal roof cladding for a large-capacity vehicle for passenger transport, comprising:

a cladding element, arranged in a region of a door drive and including, on a side facing the longitudinal center of the vehicle, a bearing surface for making contact in a precisely fitting manner with a complementary surface formed on a further cladding element, wherein the further cladding element is arranged between two elements situated opposite one another in the transverse direction of the vehicle, each cladding a door drive, and spans the central region of the roof; and coving elements adjoining said cladding element in the longitudinal direction of the vehicle.

2. The internal roof cladding as claimed in claim 1, wherein the large-capacity vehicle is a rail vehicle.

3. The internal roof cladding as claimed in claim 1, wherein at least one of the element, cladding the door drive, and the further cladding element is provided with a lighting unit.

4. The internal roof cladding as claimed in claim 1, wherein the coving elements each have a lighting unit.

5. The internal roof cladding as claimed in claim 4, wherein the lighting unit of the coving element includes a lighting fixture, fitted into a cutout of the coving element and detachably connected to the coving element.

6. An internal roof cladding for a large-capacity vehicle for passenger transport, comprising:

a cladding element, arranged in a region of a door drive and including, on a side facing the longitudinal center of the vehicle, a bearing surface for making contact in a precisely fitting manner with a complementary surface formed on a further cladding element, wherein the further cladding element includes, on a side facing the longitudinal center of the vehicle, a bearing surface for making contact in a precisely fitting manner with a complementary surface formed on an additional cladding element, wherein the additional cladding element is arranged between two further cladding elements situated opposite one another in the transverse direction of the vehicle, and spans the central region of the roof; and coving elements adjoining said cladding element in the longitudinal direction of the vehicle.

7. The internal roof cladding as claimed in claim 6, wherein the large-capacity vehicle is a rail vehicle.

8. The internal roof cladding as claimed in claim 6, wherein at least one of the element, cladding the door drive, the further cladding element and the additional cladding element is provided with a lighting unit.

9. The internal roof cladding as claimed in claim 6, wherein the coving elements each have a lighting unit.

10. The internal roof cladding as claimed in claim 9, wherein the lighting unit of the coving element includes a lighting fixture, fitted into a cutout of the coving element and detachably connected to the coving element.

* * * * *